US012600442B2

(12) United States Patent
Goldberg

(10) Patent No.: US 12,600,442 B2
(45) Date of Patent: Apr. 14, 2026

(54) AQUATIC UTILITY VEHICLE AND SUSPENSION SYSTEM THEREOF

(71) Applicant: Shadow Six Holdings, LLC, Jupiter, FL (US)

(72) Inventor: Ryan D. Goldberg, Jupiter, FL (US)

(73) Assignee: SHADOW SIX HOLDINGS, LLC, Jupiter, FL (US)

( * ) Notice: Subject to any disclaimer, the term of this patent is extended or adjusted under 35 U.S.C. 154(b) by 364 days.

(21) Appl. No.: 18/398,786

(22) Filed: Dec. 28, 2023

(65) Prior Publication Data

US 2025/0214683 A1 Jul. 3, 2025

(51) Int. Cl.
*B63B 34/10* (2020.01)

(52) U.S. Cl.
CPC ..... *B63B 34/10* (2020.02)

(58) Field of Classification Search
CPC ..... B63B 39/00; B63B 39/005; B63B 35/34; B63B 34/10; B63B 1/10; B63B 1/14; B63B 17/0081; B63B 2017/0072
See application file for complete search history.

(56) References Cited

U.S. PATENT DOCUMENTS 3,517,632 A 6/1970 Gray
3,996,872 A 12/1976 Pinchot, III
5,845,593 A * 12/1998 Birkestrand ..... B63H 9/04 114/39.21
6,176,190 B1 1/2001 Ozga
7,214,014 B2 5/2007 Stanley
7,913,636 B2 3/2011 Meyer
9,062,735 B2 * 6/2015 De Roest ..... F16F 3/10
9,150,282 B2 10/2015 Heyring et al.
9,272,753 B2 * 3/2016 Heyring ..... B63B 39/04
10,331,143 B2 6/2019 Monk et al.
D906,942 S * 1/2021 Goldberg ..... D12/317
2008/0047476 A1 * 2/2008 Stevenson ..... B63B 1/14 114/61.16
2013/0213288 A1 * 8/2013 Hall ..... B63B 17/00 114/85
2016/0368549 A1 * 12/2016 Davis ..... B62D 55/30

OTHER PUBLICATIONS

PCT International Search Report issued on Feb. 28, 2925 for International Application No. PCT/US2024/060340, filed Dec. 16, 2024.

* cited by examiner

*Primary Examiner* — Tye William Abell
(74) *Attorney, Agent, or Firm* — Sagacity Legal PLLC

(57) ABSTRACT

An aquatic utility vehicle (AUV) and suspension system for an aquatic utility vehicle is disclosed. The suspension system is configured for at least partially suspending a roll cage above at least two water engaging hulls. The suspension system includes a front mounting arrangement proximate to a bow side of the at least two water engaging hulls. The suspension system further includes a front tower type suspension mounted with the front mounting arrangement. The suspension system further includes a rear mounting arrangement proximate to stern side of the at least two water engaging hulls. The suspension system further includes a rear tower type suspension mounted with the rear mounting arrangement. During surfing, the at least two water engaging hulls are configured to articulate, and transfer wave impact forces upwards from the bow side and stern side into the roll cage through the suspension system.

17 Claims, 9 Drawing Sheets

AQUATIC UTILITY VEHICLE AND SUSPENSION SYSTEM THEREOF

BACKGROUND OF THE INVENTION

An aquatic utility vehicle (AUV) or a watercraft generally includes a body supported above multiple hulls. During extreme surfing conditions hulls are regularly exposed to dynamic water impact forces, including wave impact, slamming, and other hydrodynamic loads. These repetitive impacts can result in structural wear, material fatigue, and even catastrophic hull failure, necessitating frequent repairs and replacement. Existing watercraft designs provide limited resistance to water impact forces and often lack the necessary robustness to withstand prolonged exposure to such forces, leading to compromised vessel integrity and safety. To effectively combat the underlying challenges associated with water impact damage, the strength of the hulls must be increased while simultaneously reducing the chances of cracking.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention and explain various principles and advantages of those embodiments.

Figure 1:
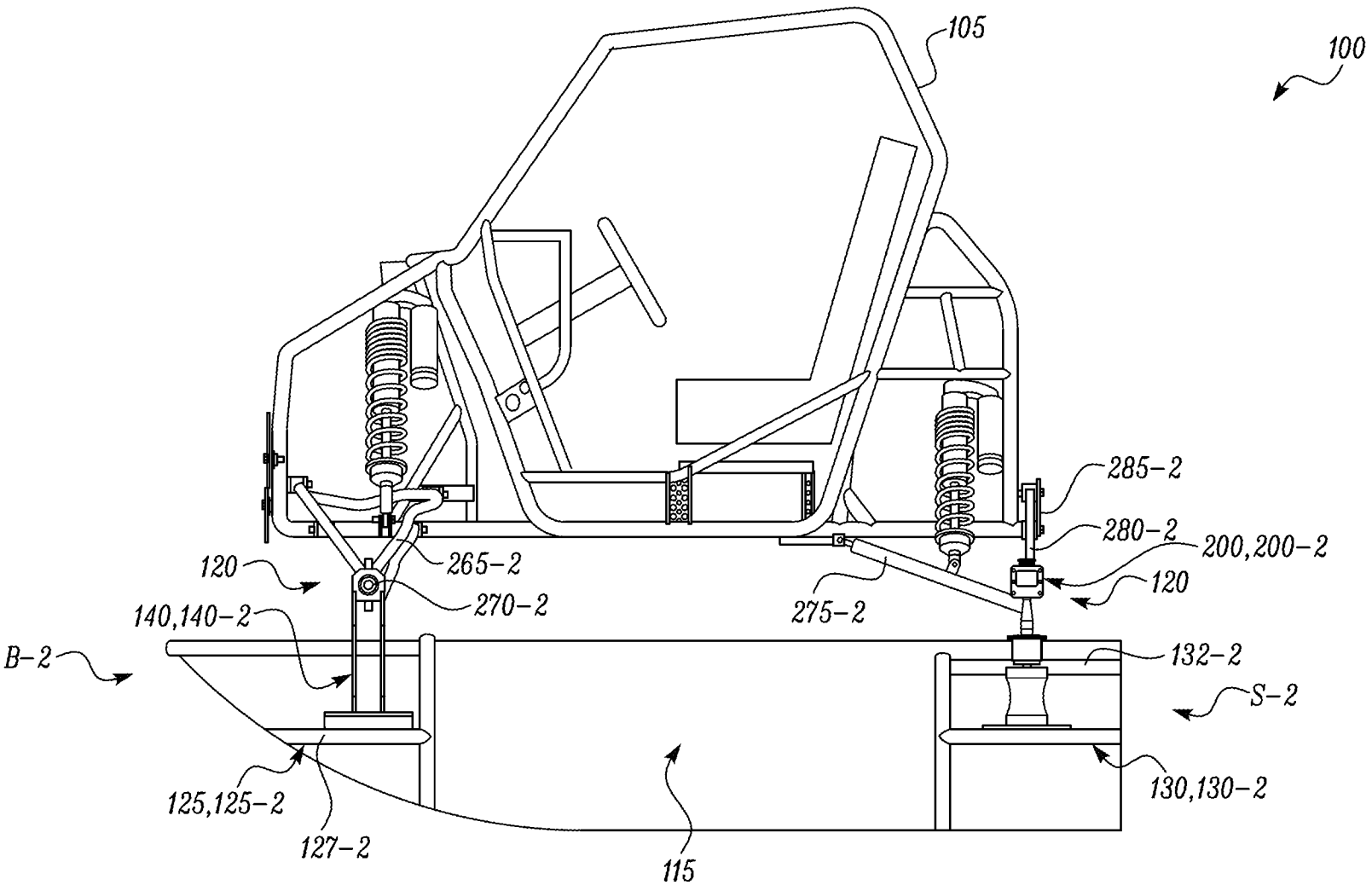
FIG. 1 is a side view of a multi hulled Aquatic Utility Vehicle (AUV), in accordance with an embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments.

The apparatus and method components have been represented where appropriate by conventional symbols in the drawings, showing only those specific details that are pertinent to understanding the embodiments so as not to obscure the description with details that will be readily apparent to those of ordinary skill in the art having the benefit of the description herein.

DETAILED DESCRIPTION OF THE INVENTION

The presently disclosed subject matter is related to Aquatic Utility Vehicles, in particular to suspension systems for multi-hulled Aquatic Utility Vehicles.

In one aspect, an aquatic utility vehicle (AUV) is described. The AUV includes a roll cage. The AUV further includes at least two water engaging hulls coupled with the roll cage. The AUV further includes a suspension system. The suspension system is configured for at least partially suspending the roll cage above the at least two water engaging hulls. The suspension system includes a front mounting arrangement proximate to a bow side of the at least two water engaging hulls. The suspension system further includes a front tower type suspension mounted with the front mounting arrangement. The suspension system further includes a rear mounting arrangement proximate to stern side of the at least two water engaging hulls. The suspension system further includes a rear tower type suspension mounted with the rear mounting arrangement. During surfing, the at least two water engaging hulls are configured to articulate, and transfer wave impact forces upwards from the bow side and stern side into the roll cage through the suspension system.

In another aspect, a suspension system for an aquatic utility vehicle (AUV) is described. The suspension system is configured for at least partially suspending a roll cage above at least two water engaging hulls. The suspension system includes a front mounting arrangement proximate to a bow side of the at least two water engaging hulls. The suspension system further includes a front tower type suspension mounted with the front mounting arrangement. The suspension system further includes a rear mounting arrangement proximate to stern side of the at least two water engaging hulls. The suspension system further includes a rear tower type suspension mounted with the rear mounting arrangement. During surfing, the at least two water engaging hulls are configured to articulate, and transfer wave impact forces upwards from the bow side and stern side into the roll cage through the suspension system.

Figure 2:
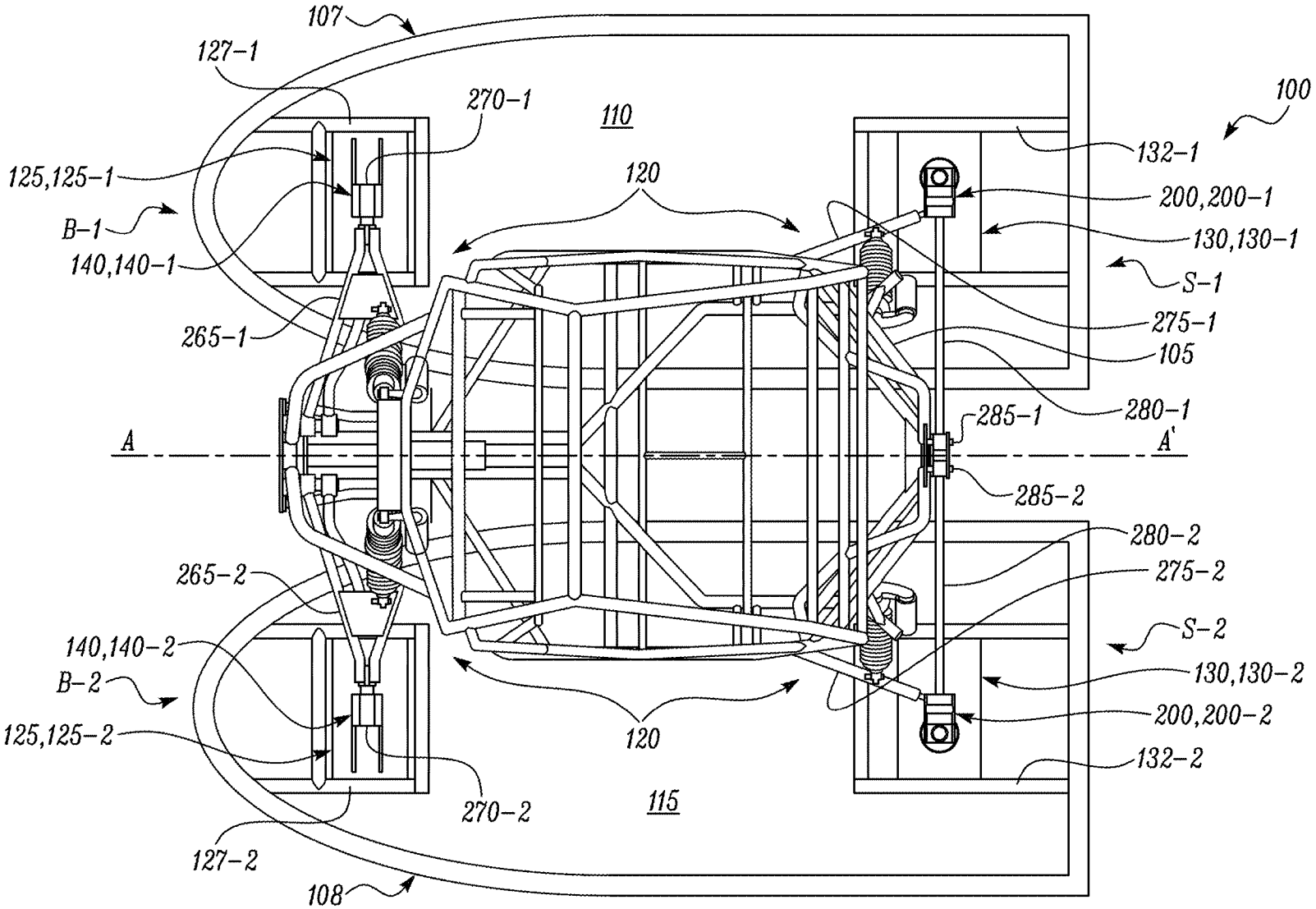
FIG. 2 is a plan view of the AUV of FIG. 1, in accordance with an embodiment.

FIG. 1 and FIG. 2 illustrate different views of a multi hulled aquatic utility vehicle (AUV) 100 in accordance with at least one embodiment. The AUV 100 includes a body or a roll cage 105. The roll cage 105 is coupled to at least two water engaging hulls 110, 115. In an embodiment, the at least two water engaging hulls includes at least a right-side hull 110 and a left-side hull 115 provided respectively on a right side 107 and a left side 108 of the roll cage 105 (see FIG. 2).

Although the AUV 100 is described with respect to one right-side hull 110 and one left-side hull 115, it will be appreciated that, in some embodiments, the AUV 100 includes multiple right-side hulls (for example, similar to the right-side hull 110) and multiple left side hulls (for example, similar to the left-side hull 115). In some embodiments, the right-side hull 110 and the left side hull 115 are moveable relative to the roll cage 105. The hulls 110, 115 are custom fabricated with respect to requirements of the performance, functionality, or operation of the AUV 100.

The roll cage 105 is supported above the right-side hull 110 and the left-side hull 115. In some embodiments, the AUV 100 includes propulsion means for propelling the AUV 100 over a water surface. The propulsion means includes one or more propellers (not illustrated). The propellers are mounted off the rear of both the left side hull and the right side hull, although alternate or additional propulsion means be used and alternate locations be used such as a telescopic arm extending down from the roll cage 105 to engage the water.

In an embodiment, the AUV 100 includes a suspension system 120. The suspension system 120 is configured for at least partially suspending the roll cage 105 above the right-side hull 110 and the left-side hull 115. In an embodiment, the suspension system 120 includes a front mounting arrangement 125 and a rear mounting arrangement 130. In an embodiment, a front mounting arrangement 125-1 is proximate to a front side or a bow side B-1 of the right-side hull 110 and another front mounting arrangement 125-2 is proximate to a front side or a bow side B-2 of the left-side hull 115. Further in an embodiment, a rear mounting arrangement 130-1 is proximate to a rear side or a stern side S-1 of the right-side hull 110 and another rear mounting arrangement 130-2 is proximate to a rear side or a stern side S-2 of the left-side hull 115. Similarly, front mounting arrangements (for example, similar to the front mounting arrangement 125) and rear mounting arrangements (for example, similar to the rear mounting arrangement 130), when provided, can be associated with different hull arrangements with right side hulls and left side hulls in different embodiments.

In an embodiment, the front mounting arrangement 125 includes a mounting plate 127 and the rear mounting arrangement 130 includes a mounting box 132. Alternatively, any other mounting or locating means be provided with the bow side B of the right-side hull 110 and the stern side S of the left-side hull 115 for placing the suspension system 120. Referring to FIGS. 1 and 2 together, mounting plates 127-1 and 127-2 are respectively associated with the front mounting arrangements 125-1 and 125-2, and mounting boxes 132-1 and 132-2 are respectively associated with the rear mounting arrangements 130-1 and 130-2. In an example, the mounting plates 127-1, 127-2 and the mounting boxes 132-1, 132-2 are respectively secured to the bow sides B-1, B-2 and the stern sides S-1, S-2 of the right-side hull 110 and the left-side hull 115 through one or more of bolting, riveting, welding, and/or any joining process now known or in the future developed. In an example, the mounting plates 127-1, 127-2 and the mounting boxes 132-1, 132-2 are fabricated of aluminum, steel, stainless steel, fiber, asbestos, and/or materials now known or in the future developed. The suspension system 120 includes a front tower type suspension 140-1 associated with the front mounting arrangement 125-1, and front tower type suspension 140-2 associated with the front mounting arrangement 125-2. Further, the suspension system 120 includes a rear tower type suspension 200-1 associated with the rear mounting arrangement 130-1, and rear tower type suspension 200-2 associated with the rear mounting arrangement 130-2.

Figure 3:
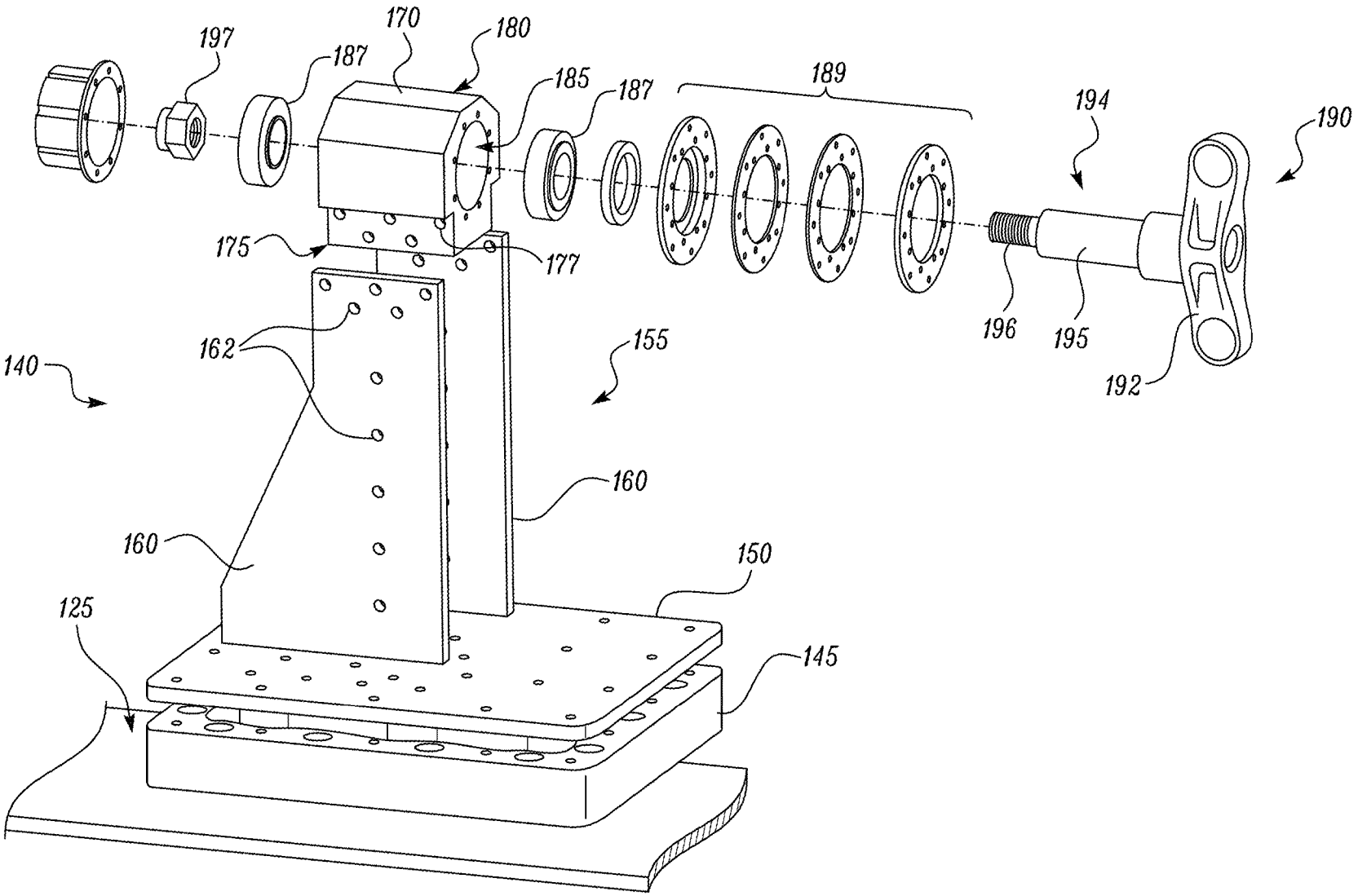
FIG. 3 is an exploded view illustrating a front tower type suspension of a suspension system of the AUV of FIGS. 1 and 2, in accordance with an embodiment.

Referring to FIG. 3, a front tower type suspension 140 of the suspension system 120 is described. It will be appreciated that functional, structural, positional, etc. details referred to the front tower type suspension 140 are equally applicable to the front tower type suspensions 140-1, 140-2. The front tower type suspension 140 is configured to be mounted on the mounting plate 127 of the front mounting arrangement 125. In an embodiment, the front tower type suspension 140 includes a base plate spacer 145 configured to be mounted over the mounting plate 127. The base plate spacer 145 is secured to the mounting plate 127 through bolting, riveting, welding, and/or any joining processes now known or in the future developed.

Figure 4:
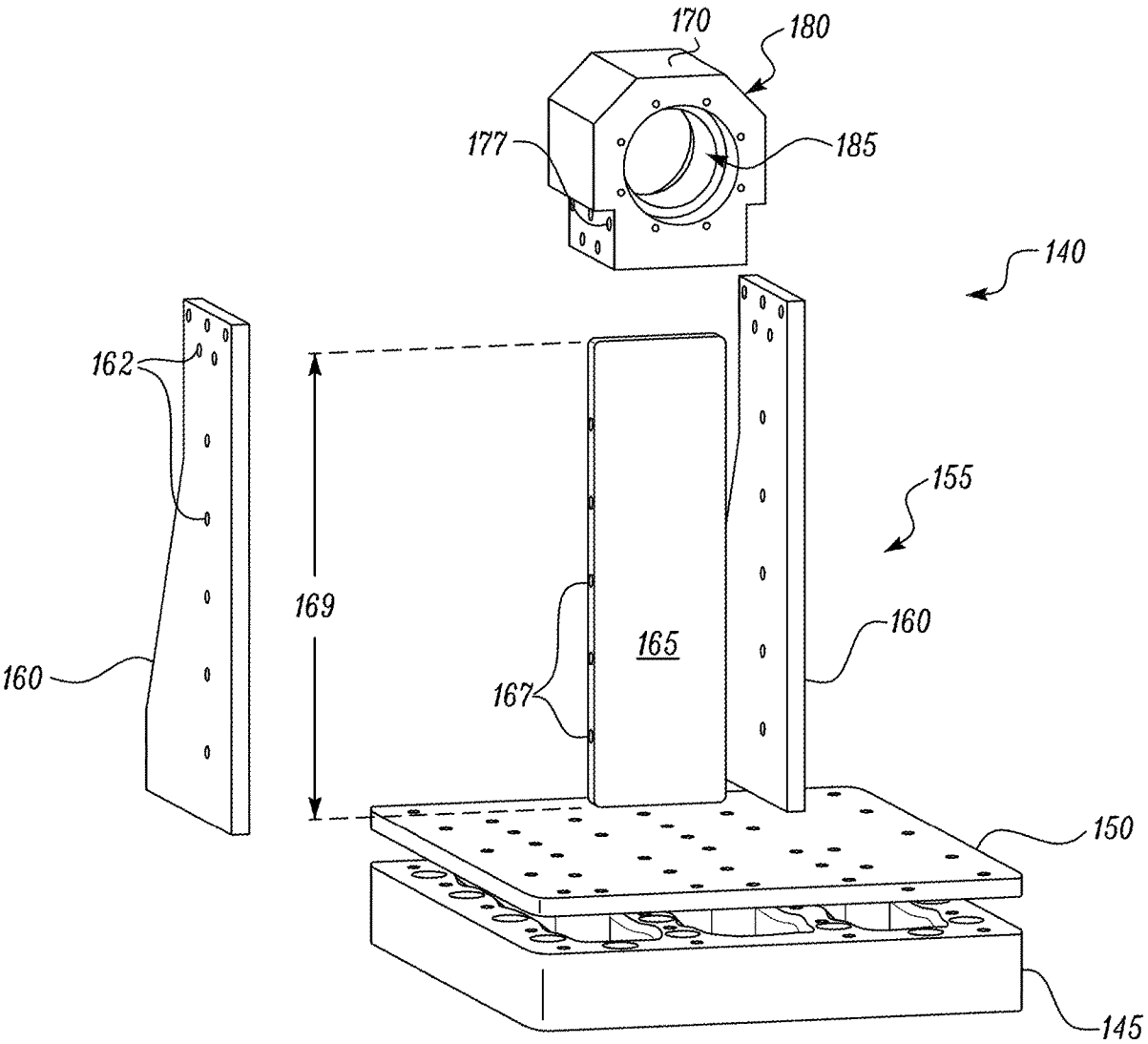
FIG. 4 is a diagram illustrating a front perspective view of a front suspension tower structure of FIG. 3.

The front tower type suspension 140 further includes a front side base plate 150 configured to be mounted over the base plate spacer 145. The front side base plate 150 is secured to the base plate spacer 145 through bolting, riveting, welding, and/or any joining processes now known or in the future developed. The front tower type suspension 140 further includes a front suspension tower structure 155 extending from the front side base plate 150. FIG. 4 illustrates the front suspension tower structure 155 of FIG. 3.

Referring to FIGS. 3 and 4 together, the front suspension tower structure 155 includes a plurality of upright or vertical side plates 160. The upright side plates 160 are welded to the front side base plate 150. In an example, the upright side plates 160 define a polygonal shape. It will be appreciated that alternatively the upright side plates 160 define any other shape now known or in the future developed. The upright side plates 160 further includes a plurality of holes 162. The front suspension tower structure 155 further includes an upright or vertical center gusset 165 (see FIG. 4). The upright center gusset 165 defines a cuboidal shape. The upright center gusset 165 further includes a plurality of holes 167 defined along its length 169. In an example, the upright center gusset 165 is configured to be secured to the upright side plates 160 such that the upright center gusset 165 is sandwiched between the plurality of upright side plates 160. In an example, the upright center gusset 165 is positioned with respect to the plurality of upright side plates 160 such that the holes 167 and 162 are correspondingly placed and aligned with respect to each other, and the upright center gusset 165 and the plurality of upright side plates 160 are joined by passing fasteners through the holes 167, 162 or through bolting, riveting, and/or any joining processes now known or in the future developed. In another example, the upright center gusset 165 is welded to the plurality of upright side plates 160.

The front tower type suspension 140 further includes a front bearing housing 170 configured to be mounted over the front suspension tower structure 155. The front bearing housing 170 defines a bottom portion 175 and a top portion 180. The bottom portion 175 is configured to be secured to the front suspension tower structure 155. In an example, the bottom portion 175 defines a plurality of holes 177, and the bottom portion 175 is positioned with respect to the plurality of upright side plates 160 and the upright center gusset 165 such that the holes 177 and at least some of the holes 162 are correspondingly aligned such that fasteners (for example, bolts, studs, rivets, now known or in the future developed) are passed therethrough to secure the front bearing housing 170 with the front suspension tower structure 155. Other manner of achieving such fastening is attained through riveting, welding, or any other joining process now known or in the future developed.

The top portion 180 of the front bearing housing 170 defines a cavity or receptacle 185 fitted with a plurality of tapered bearings 187. The front tower type suspension 140 further includes a spindled knuckle 190. In an example, the spindled knuckle 190 is configured to be rotatably secured with the front bearing housing 160. In this regard, the spindled knuckle 190 includes a knuckle portion 192 and a spindle shaft 194 extending from the knuckle portion 192. The spindle shaft 194 is configured to be received and secured in the receptacle 185 of the top portion 180 such that a shaft portion 195 of the spindle shaft 194 engages the plurality of tapered bearings 187. In an example, the spindle shaft 194 includes a threaded end 196 extending from the shaft portion 195. The threaded end 196 is configured to be secured with a corresponding nut 197 for securing the spindled knuckle 190 within the front bearing housing 160. In an embodiment, the front bearing housing 160 includes certain other components such as seals, gaskets, covers, or similar elements 189 now known or developed in future for water proofing, functioning, and securing of the spindled knuckle 190.

Figure 5:
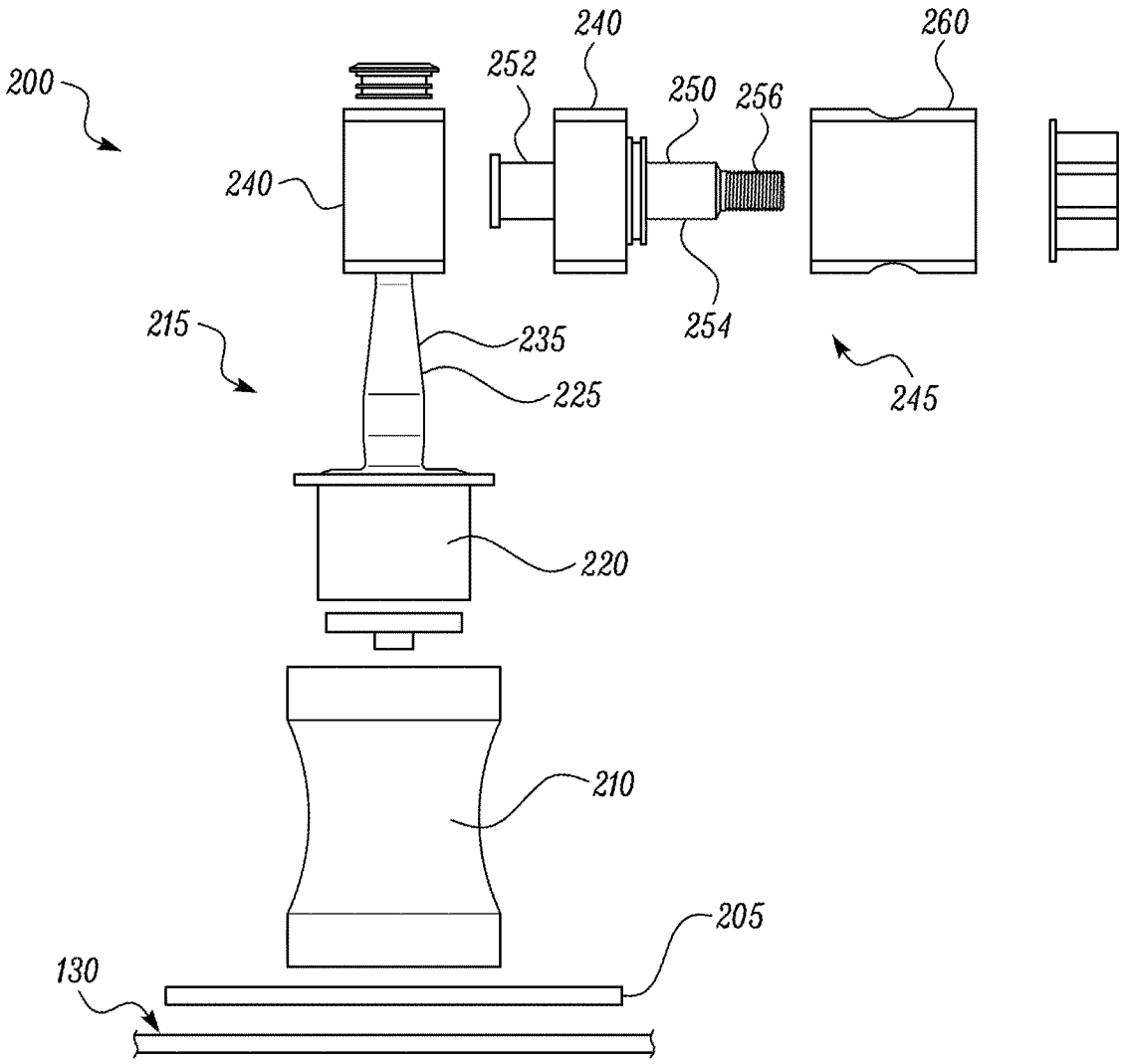
FIG. 5 is a diagram illustrating a rear tower type suspension of the suspension system, in accordance with an embodiment.

Referring to FIG. 5, a rear tower type suspension 200 of the suspension system 120 is described. It will be appreciated that functional, structural, positional, etc. details referred to the rear tower type suspension 200 are equally applicable to the rear tower type suspensions 200-1, 200-2. The rear tower type suspension 200 is configured to be mounted on the mounting box 132 (see FIG. 1) of the rear mounting arrangement 130. In an embodiment, the rear tower type suspension 200 includes a rear side base plate 205 configured to be mounted on the mounting box 132. The rear side base plate 205 is secured to the mounting box 132 through one or more of bolting, riveting, welding, or any other joining processes now known or developed in future.

Figure 6:
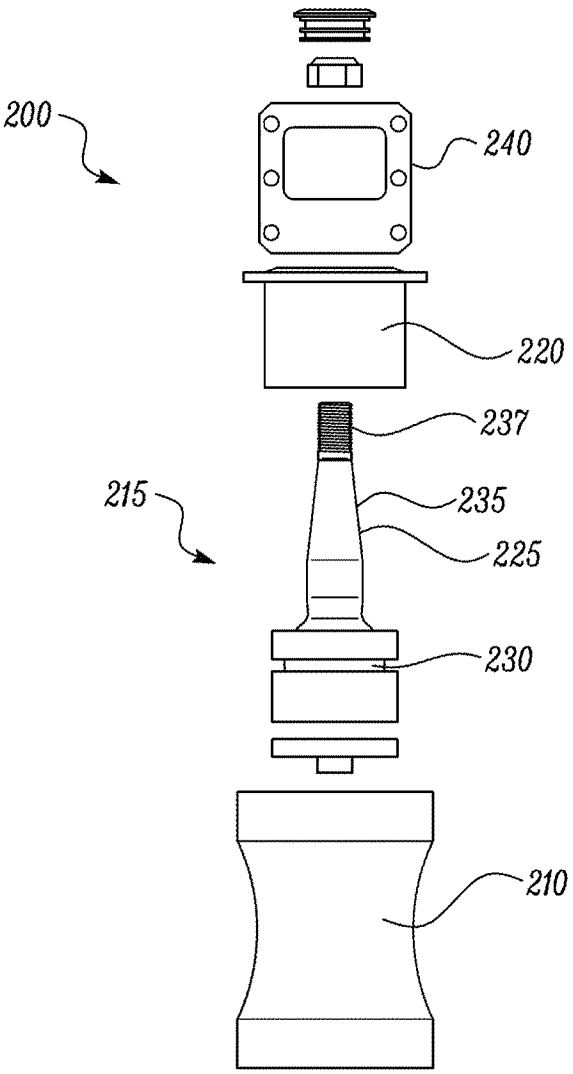
FIG. 6 is a diagram illustrating a ball joint assembly configured with a rear suspension tower structure of the rear tower type suspension of FIG. 5.

The rear tower type suspension 200 further includes a rear suspension tower structure 210 extending from the rear side base plate 205. In an example, rear suspension tower structure 210 includes a dumbbell shape. It will be appreciated that alternatively the rear suspension tower structure 210 define any appropriate shape now known or in the future developed. The rear tower type suspension 200 further includes a ball joint assembly 215 configured with the rear suspension tower structure 210. FIG. 6 is a diagram illustrating the ball joint assembly 215 configured with the rear suspension tower structure 210.

Referring to FIGS. 5 and 6 together, the ball joint assembly 215 includes a ball joint housing 220 extending from the rear suspension tower structure 210. In an embodiment, the ball joint housing 220 is configured to be received within the rear suspension tower structure 210. The ball joint assembly 215 further includes a ball joint stud 225 configured with the ball joint housing 220. In an embodiment, the ball joint stud 225 includes a ball part 230 and an elongated stud part 235 extending (for example, integrally) from the ball part 230. The ball part 230 is configured to be movably received within the ball joint housing 220. The elongated stud part 235 defines a truncated cone profile and a threaded end 237.

Figure 7:
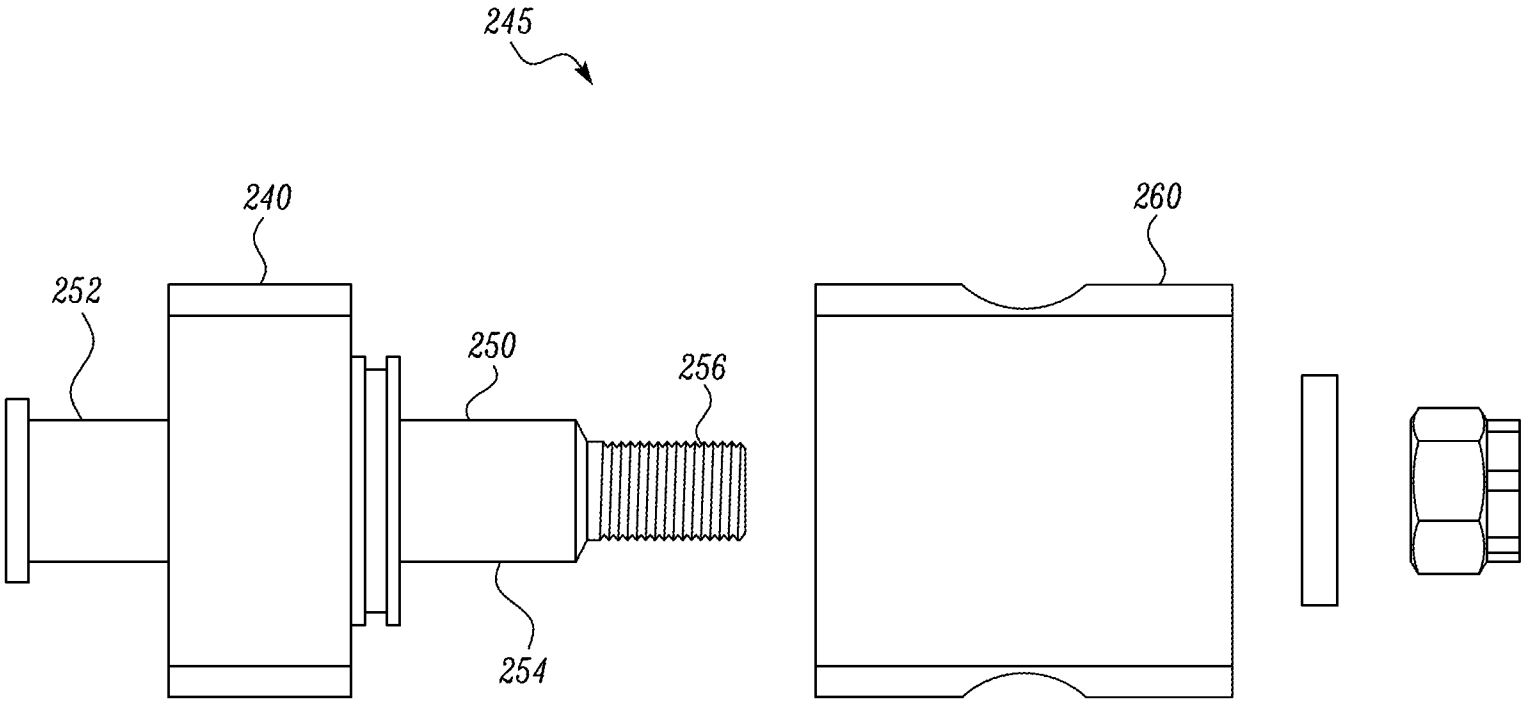
FIG. 7 is a diagram illustrating a rear bearing housing of the rear tower type suspension of FIG. 5.

In an embodiment, the rear tower type suspension 200 further includes a pivot housing 240 configured to be mounted over the ball joint assembly 215. In an embodiment, the pivot housing 240 is fastened to the threaded end 237. Further in an embodiment, the rear tower type suspension 200 includes a rear bearing housing 245 configured with the pivot housing 240. FIG. 7 is a diagram illustrating the rear bearing housing 245. In an embodiment, an orientation of the rear bearing housing 245 is at right angle with the pivot housing 240. It will be appreciated that alternatively the rear bearing housing 245 is oriented with respect to the pivot housing 240 at any acute or obtuse angle.

As illustrated in FIGS. 5 and 7, the rear bearing housing 245 includes a spindle shaft 250. The spindle shaft 250 defines a first end 252 configured to be received within the pivot housing 240. The spindle shaft 250 further defines a middle portion 254 extending from the first end 252, and a threaded portion 256 extending from the middle portion 254. In an embodiment, the rear bearing housing 245 further includes a bearing component 260. The bearing component 260 is configured to receive the middle portion 254 and the threaded portion 256, at least in part, and is secured to the spindle shaft 250 by fastening the threaded portion 256 with a nut (not illustrated). In some embodiments, the bearing component 260 includes certain other components such as seals, gaskets, covers, or similar elements (not illustrated) now known or developed in future for water proofing, functioning, and securing of the spindle shaft 250, thereto.

Referring to FIGS. 1 through 4 collectively, the front tower type suspension 140 is coupled to the roll cage 105. In an embodiment, the spindled knuckle 190 of the front tower type suspension 140 is coupled to the roll cage 105 via A-arms linkages through a first heim joint (for example, see A-arm linkage 265-2 and first heim joint 270-2 associated with the front tower type suspension 140-2). The A-arms linkages 265-1 and first heim joint 270-1 are associated with the front mounting arrangement 125-1, and A-arms linkages 265-2 and first heim joint 270-2 are associated with the front mounting arrangement 125-2. It will be appreciated that functional, structural, positional, etc. details referred to the A-arms linkages and first heim joint are equally applicable to the A-arms linkages 265-1, 265-2 and first heim joints 270-1, 270-2. In operation during motion or surfing of the AUV 100 over a water surface and the right side hull 110 and the left side hull 115 experiencing the wave impact forces, the spindled knuckle 190 locks each of the least two water engaging hulls 110, 115 and maintains a parallel orientation and proper alignment of the right-side hull 110 and the left-side hull 115 with respect to each other as illustrated in FIG. 2. In an embodiment, the spindled knuckle 190 locks the two hulls 110, 115 in a parallel position while allowing a pitch of the front tower type suspension 140 to change.

Figure 8:
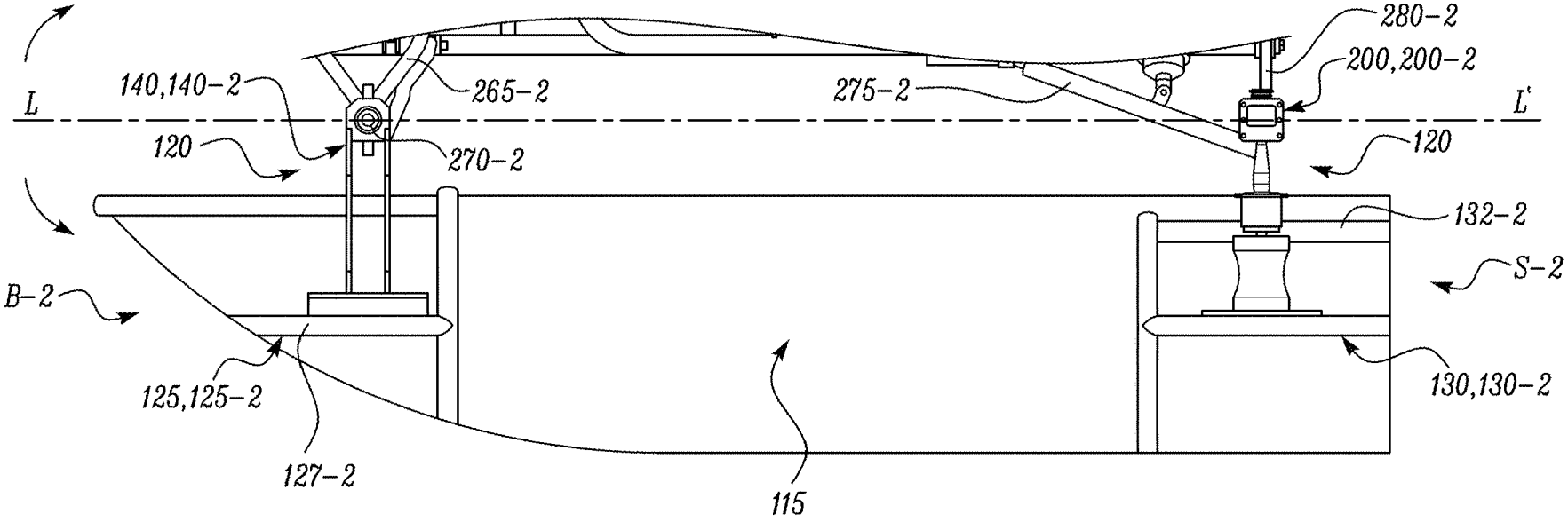
FIG. 8 is a partial side view of a left side hull of the AUV of FIG. 1, in accordance with an embodiment.

FIG. 8 is a partial side view of the left side hull 115 in accordance with an embodiment. In an embodiment, referring to FIGS. 1 through 4 and 8, during motion or surfing of the AUV 100 over a water surface, as the right side hull 110 and the left side hull 115 experience the wave impact forces, the A-arms linkages 265 are configured for forward and backward rotation of each of the least two water engaging hulls 110, 115, and allows a pitch of the each of the least two water engaging hulls 110, 115 to change via the spindled knuckle 190 and the front bearing housing 160. As illustrated in FIG. 8, the left side hull 115 is configured for forward and backward rotation, and a pitch of the left side hull 115 is configured to change via the front bearing housing 160 about an axis L-L' passing through the joint of the spindled knuckle 190, the A-arms linkages 265, and the heim joint 270. The same is equally applicable to the right side hull 110. In an embodiment, the front bearing housing 160 allows pitch to change via rolling. In an embodiment, the distance between the front tower type suspension 140 at the front and the rear tower type suspension 200 at the rear increases and decreases respectively as the suspension system 120 compresses and rebounds. During surfing, a distance between the hulls 110, 115 is also able to change. However, the hulls 110, 115 are always at level and in parallel relationship to each other. Accordingly, in an embodiment, front tower type suspension 140 restricts a side to side rolling of the hulls 110, 115.

Referring to FIGS. 1 through 2 and 5 through 7 collectively, the rear tower type suspension 200 is coupled to the roll cage 105. In an embodiment, the rear tower type suspension 200 is coupled with the roll cage 105 via trailing arms 275 and radius rods 280. Further in an embodiment, the ball joint assembly 215 is coupled with the trailing arms 275 and radius rods 280 through second heim joints 285. The trailing arms 275-1, radius rods 280-1, and second heim joint 285-1 are associated with the rear mounting arrangement 130-1, and trailing arms 275-2, radius rods 280-2, and second heim joint 285-2 are associated with the rear mounting arrangement 130-2. It will be appreciated that functional, structural, positional, etc. details referred to the trailing arms 275, radius rods 280, and second heim joint 285 are equally applicable to the trailing arms 275-1, 275-2, radius rods 280-1, 280-2, and second heim joints 285-1, 285-2. In operation during motion of the AUV 100 over a water surface and the right side hull 110 and the left side hull 115 experiencing the wave impact forces, the rear ball joint tower type suspension 200 allows a limited range of forward, backward, and side to side articulation of the at least two water engaging hulls 110, 115. In an embodiment, the ball joint assembly 215 on both the hulls 110, 115 is held parallel due to parallel orientation of the hulls 110, 115 as achieved through the front tower type suspension 140. However, during surfing of the AUV 100, the ball joint assembly 215 is able to articulate through the full range of necessary motion created by the changing alignment of the front tower type suspension 140 at the front and the rear tower type suspension 200 at the rear as the suspension system 120 travels through its full range of motion. This allows for the suspension system 120 to follow a U-shaped arc during compression and expansion.

Figure 9:
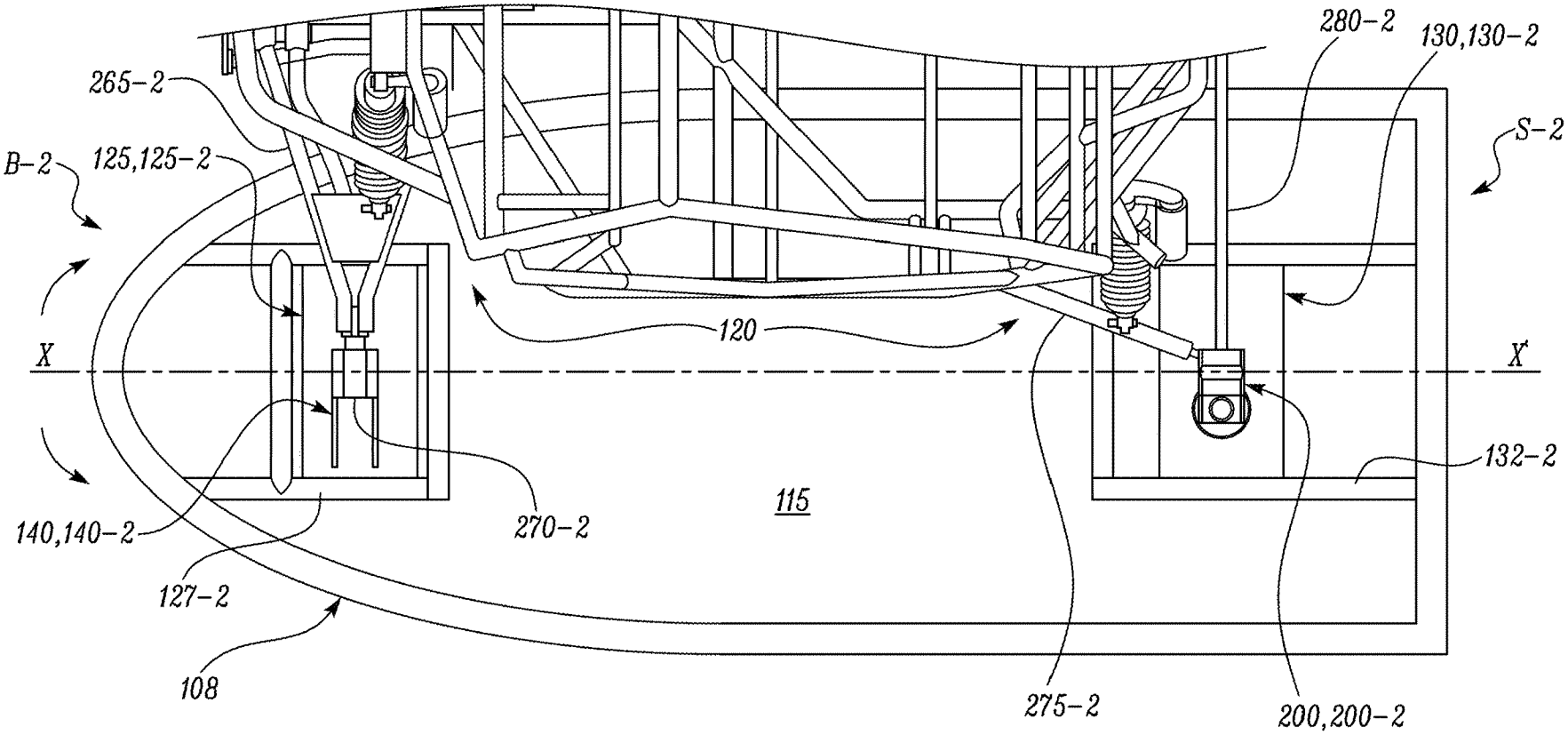
FIG. 9 is a partial plan view illustrating the left side hull of the AUV of FIG. 2, in accordance with an embodiment.

FIG. 9 is a diagrammatic plan view of a hull in accordance with an embodiment. It will be appreciated that the hull of FIG. 9 can be the left side hull 115 or the right side hull 110. Referring back to FIG. 8, the left side hull 115 is configured for forward and backward rotation about an axis L-L', and as illustrated in FIG. 9, the left side hull 115 is configured for side to side articulation about an axis X-X'. The same is equally applicable to the right side hull 110.

The present invention provides an efficient, effective, and robust design for an Aquatic Utility Vehicle 100. The AUV 100 is configured for extreme surf capabilities and rescue. The roll cage 105 of the AUV 100 is held by the suspension system 120 above the right side hull 110 and the left side hull 115. This allows for better performance, handling, versatility, and ride quality. In view of the foregoing description, during surfing the suspension system 120 of the AUV 100 allows the hulls 110, 115 to fully articulate along with the suspension system 120 while transferring the force of wave impacts upward from the bow side B i.e., through the front tower type suspension 140 and the stern side S i.e., through the rear tower type suspension 200 of the vessel into the roll cage 105 rather than into the center of the hulls 110, 115. This increases the strength of the hulls 110, 115 tremendously, while dramatically reducing the chances of cracking the hulls 110, 115.

Moreover, the two strongest points of the hulls 110, 115 are the bow and the stern. The suspension system 120 design allows the hulls 110, 115 and the roll cage 105 to form a triangle. The triangle shape allows to transfer force away from the middle of the hulls 110, 115 up through the suspension system 120 and the roll cage 105.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element preceded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the description. This method is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

I claim:

1. An aquatic utility vehicle (AUV) comprising:

a roll cage;

at least two water engaging hulls coupled with the roll cage; and a suspension system, configured for at least partially suspending the roll cage above the at least two water engaging hulls, the suspension system including, at each of a left side and a right side of the roll cage:

a front mounting arrangement proximate to a bow side of the at least two water engaging hulls, a front tower type suspension mounted with the front mounting arrangement, the front tower type suspension including a front bearing housing coupled to the front mounting arrangement and a spindled knuckle rotatably secured with the front bearing housing, an A-arm linkage coupling the spindled knuckle to the roll cage, a rear mounting arrangement proximate to stem side of the at least two water engaging hulls, and a rear tower type suspension mounted with the rear mounting arrangement, wherein during surfing, the at least two water engaging hulls are configured to articulate, and transfer wave impact forces upwards from the bow side and stem side into the roll cage through the suspension system, A-arms linkages associated with both the left side and the right side are configured for forward and backward rotation of each of the at least two water engaging hulls, and allows pitch of the each of the at least two water engaging hulls to change via the front bearing housing, and the spindled knuckle locks each of the at least two water engaging hulls and maintains a parallel orientation of the at least two water engaging hulls with respect to each other.

2. The AUV of claim 1, wherein the front mounting arrangement includes a mounting plate and the rear mounting arrangement includes a mounting box.

3. The AUV of claim 1, wherein the at least two water engaging hulls includes at least a right-side hull and a left-side hull provided respectively on right side and left side of the roll c age.

4. The AUV of claim 3, wherein the front tower type suspension includes:

a base plate spacer configured to be mounted over the front mounting arrangement;

a front side base plate configured to be mounted over the base plate spacer;

a front suspension tower structure extending from the front side base plate, wherein the front bearing housing is mounted over the front suspension tower structure to be coupled with the front mounting arrangement.

5. The AUV of claim 4, wherein the front suspension tower structure includes:

a plurality of upright side plates, and an upright center gusset sandwiched between the plurality of upright side plates.

6. The AUV of claim 4, wherein the spindled knuckle of the front tower type suspension is coupled to the roll cage via A-arms linkages through a heim joint.

7. The AUV of claim 3, wherein the rear tower type suspension includes:

a rear side base plate configured to be mounted over the rear mounting arrangement;

a rear suspension tower structure extending from the rear side base plate;

a ball joint assembly configured with the rear suspension tower structure;

a pivot housing configured to be mounted over the ball joint assembly; and a rear bearing housing configured with the spindled pivot assembly.

8. The AUV of claim 7, wherein the ball joint assembly includes:

a ball joint housing extending from the rear suspension tower structure, and a ball joint stud configured with the ball joint housing.

9. The AUV of claim 7, wherein the rear tower type suspension is coupled with the roll cage via trailing arms and radius rods.

10. The AUV of claim 9, wherein the ball joint assembly is coupled with the trailing arms and radius rods through heim joints.

11. The AUV of claim 10, wherein the rear ball joint tower type suspension allows a limited range of forward, backward, and side to side articulation of the at least two water engaging hulls.

12. A suspension system for an aquatic utility vehicle (AUV), the suspension system being configured for at least partially suspending a roll cage above at least two water engaging hulls, the suspension system comprising:

at each of a left side and a right side of the roll cage, a front mounting arrangement proximate to a bow side of the at least two water engaging hulls;

a front tower type suspension mounted with the front mounting arrangement, the front tower type suspension including a front bearing housing coupled to the front mounting arrangement and a spindled knuckle rotatably secured with the front bearing housing;

an A-arm linkage coupling the spindled knuckle to the roll cage, a rear mounting arrangement proximate to stem side of the at least two water engaging hulls; and a rear tower type suspension mounted with the rear mounting arrangement, wherein during surfing, the at least two water engaging hulls are configured to articulate, and transfer wave impact forces upwards from the bow side and stem side into the roll cage through the suspension system, A-arms linkages associated with both the left side and the right side are configured for forward and backward rotation of each of the at least two water engaging hulls, and allows pitch of the each of the at least two water engaging hulls to change via the front bearing housing, and the spindled knuckle locks each of the at least two water engaging hulls and maintains a parallel orientation of the at least two water engaging hulls with respect to each other.

13. The suspension system of claim 12, wherein the at least two water engaging hulls includes at least a right-side hull and a left-side hull provided respectively on right side and left side of the roll cage.

14. The suspension system of claim 13, wherein the front tower type suspension includes:

a base plate spacer configured to be mounted over the front mounting arrangement;

a front side base plate configured to be mounted over the base plate spacer;

a front suspension tower structure extending from the front side base plate, wherein the front bearing housing is mounted over the front suspension tower structure to be coupled with the front mounting arrangement, the front suspension tower structure includes:

a plurality of upright side plates, and an upright center gusset sandwiched between the plurality of upright side plates.

15. The suspension system of claim 14, wherein the spindled knuckle of the front tower type suspension is coupled to the roll cage via A-arms linkages through a heim joint.

16. The suspension system of claim 13, wherein the rear tower type suspension includes:

a rear side base plate configured to be mounted over the rear mounting arrangement;

a rear suspension tower structure extending from the rear side base plate;

a ball joint assembly configured with the rear suspension tower structure, the ball joint assembly includes:

a ball joint housing extending from the rear suspension tower structure, and a ball joint stud configured with the ball joint housing;

a rear bearing housing configured to be mounted over the ball joint assembly; and a spindled pivot assembly configured with the rear bearing housing.

17. The suspension system of claim 16, wherein the rear tower type suspension is coupled with the roll cage via trailing arms and radius rods, wherein the ball joint assembly is coupled with the trailing arms and radius rods through heim joints, and wherein the rear ball joint tower type suspension allows a limited range of forward, backward, and side to side articulation of the at least two water engaging hulls.

* * * * *